US011708807B1

(12) United States Patent
Hu et al.

(10) Patent No.: US 11,708,807 B1
(45) Date of Patent: Jul. 25, 2023

(54) SYSTEMS FOR A COOLER

(71) Applicant: Ford Global Technologies, LLC, Dearborn, MI (US)

(72) Inventors: Liangjun Hu, Bloomfield Hills, MI (US); Eric Kurtz, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/814,629

(22) Filed: Jul. 25, 2022

(51) Int. Cl.
*F02M 26/30* (2016.01)
*F02M 26/21* (2016.01)
*F02M 26/27* (2016.01)

(52) U.S. Cl.
CPC ..... *F02M 26/30* (2016.02); *F02M 26/21* (2016.02); *F02M 26/27* (2016.02)

(58) Field of Classification Search
CPC ..... F02M 26/30; F02M 26/21; F02M 26/27
See application file for complete search history.

(56) References Cited

U.S. PATENT DOCUMENTS 6,708,677 B2 3/2004 Brosseau et al.
6,976,480 B2 * 12/2005 Miyoshi ..... F02M 26/32 123/568.2
7,213,613 B2 5/2007 Spakowski et al.
7,614,443 B2 11/2009 Usui et al.
8,528,529 B2 9/2013 Ewen
2005/0199226 A1 * 9/2005 Watanuki ..... F02M 26/69 123/568.2
2006/0288694 A1 * 12/2006 Hayashi ..... F02M 26/28 60/320
2011/0031426 A1 * 2/2011 Tyler ..... F02M 26/26 251/251
2011/0108013 A1 * 5/2011 Melhem ..... F02M 26/26 123/568.22

FOREIGN PATENT DOCUMENTS

JP 6133771 B2 5/2017
KR 100895483 B1 5/2009

* cited by examiner

*Primary Examiner* — Xiao En Mo
(74) *Attorney, Agent, or Firm* — Vincent Mastrogiacomo; McCoy Russell LLP

(57) ABSTRACT

Methods and systems are provided for a cooler. In one example, a system includes a dual poppet valve assembly arranged in a primary chamber of the cooler. The cooler further includes a plurality of ribs arranged between the dual poppet valve assembly and a plurality of tubes of the cooler. The ribs configured to distribute EGR to the plurality of tubes.

20 Claims, 5 Drawing Sheets

SYSTEMS FOR A COOLER

FIELD

The present description relates generally to a dual poppet valve assembly for a cooler

BACKGROUND/SUMMARY

As emission regulations become more stringent, higher EGR flow rates and more advanced EGR cooler systems are desired to meet new guidelines. Dual poppet valves may be used in EGR system to provide higher EGR flow rates. However, these valves may be prone to some issues.

One example poppet valve is shown by Spakowski et al. in U.S. Pat. No. 7,213,613. Therein, an EGR valve includes a dual poppet configuration, wherein a first side of the valve is configured to fully seal via a first poppet prior to a second side sealing via a second poppet. A spring provides the biased closure of the first side relative to the second side.

However, the inventors have identified some issues with the approaches described above. For example, EGR flow through an EGR cooler via the dual poppet valve may not be uniformly distributed. The flow pattern through the EGR cooler via the dual poppet valve of Spakowski may result in a biasing of the EGR flow to outer tubes of a plurality of tubes of the EGR cooler with less EGR flowing through more centrally located tubes. During certain conditions, EGR gases may include corrosive elements, such as nitric acid, which may reduce a longevity of the EGR cooler. Thus, more uniform EGR flow distribution through the EGR cooler is desired not only for enhanced EGR cooling but also for more even wear of cooler components, resulting in improved longevity.

In one example, the issues described above may be addressed by an EGR system comprising a dual poppet valve arranged upstream of a cooler relative to a direction of EGR flow, and ribs arranged between the dual poppet valve and a plurality of tubes of the cooler. In this way, flow distribution through the plurality of tubes may be improved via the ribs.

As one example, the dual poppet valve may be actuated via a camshaft. The dual poppet valve may be symmetric, wherein a cam of the camshaft may actuate shafts corresponding to a first poppet and a second poppet of the dual poppet valve. The dual poppet valve may be arranged in an upstream location relative to the plurality of tubes, closer to an inlet into which EGR enters a primary chamber of the cooler. By doing this, the ribs in combination with the position of the valve may result in enhanced EGR flow distribution and improved control of the EGR valve.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
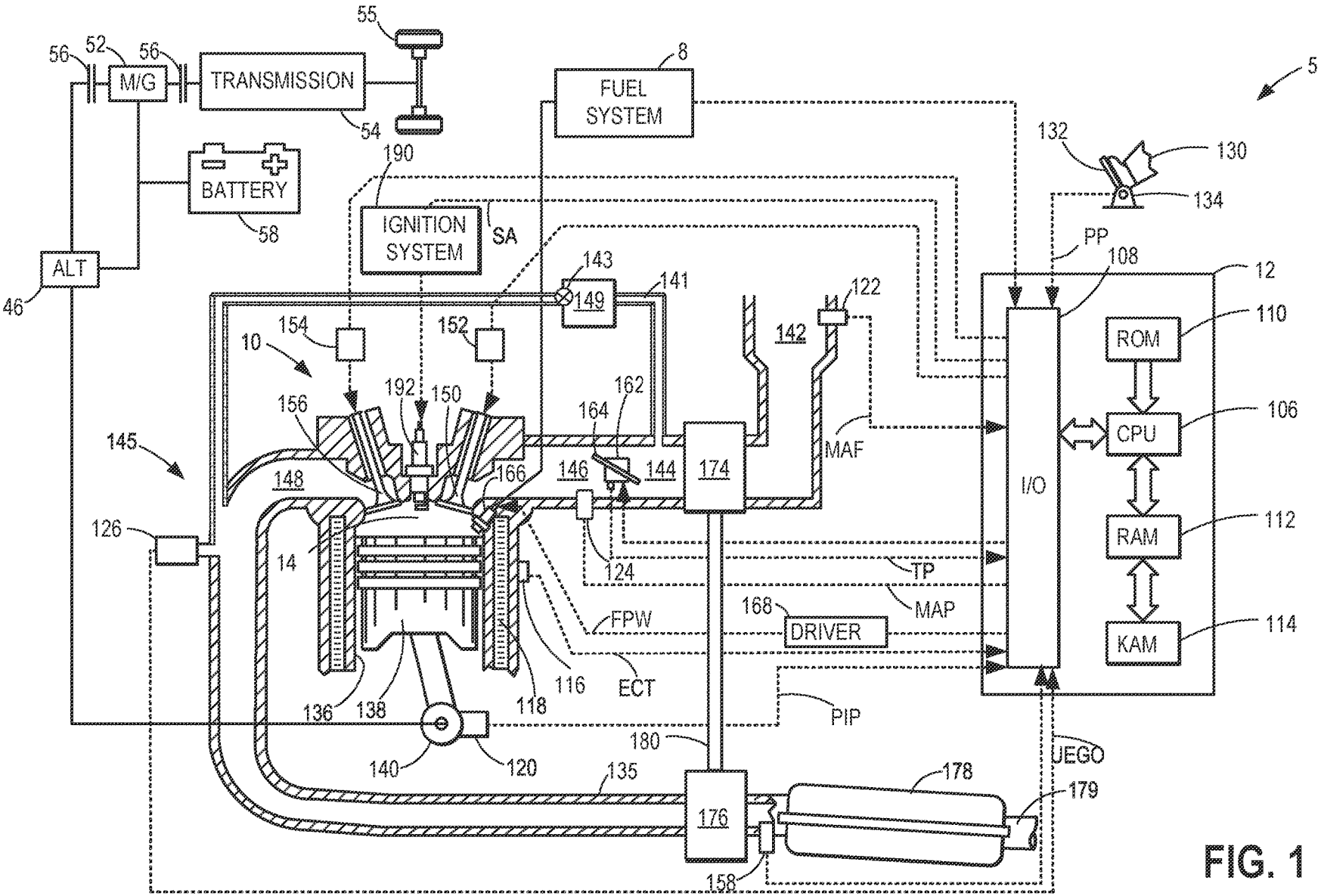
FIG. 1 illustrates a schematic of an engine included in a hybrid vehicle.
Figure 3:
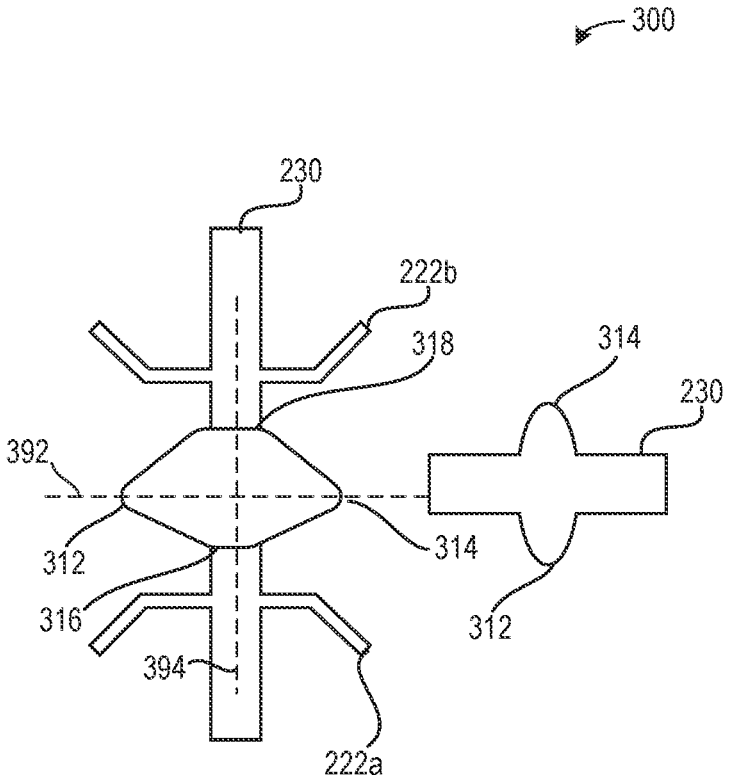
FIG. 3 illustrates a schematic of the dual poppet valve and a camshaft thereof.
Figure 4:
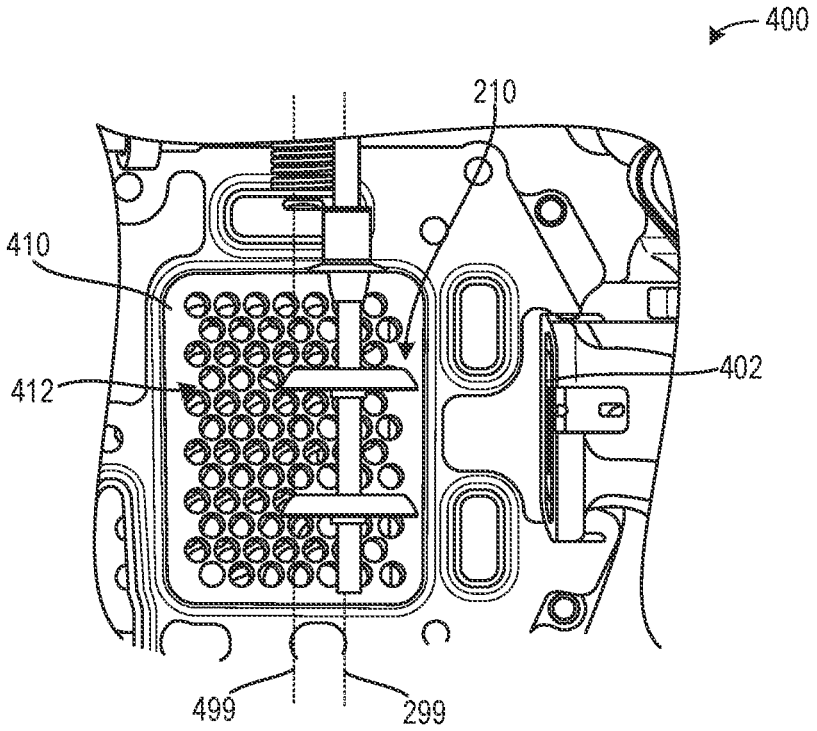
FIG. 4 illustrates a position of the dual poppet valve relative to a plurality of tubes and an inlet of the cooler.
Figure 5:
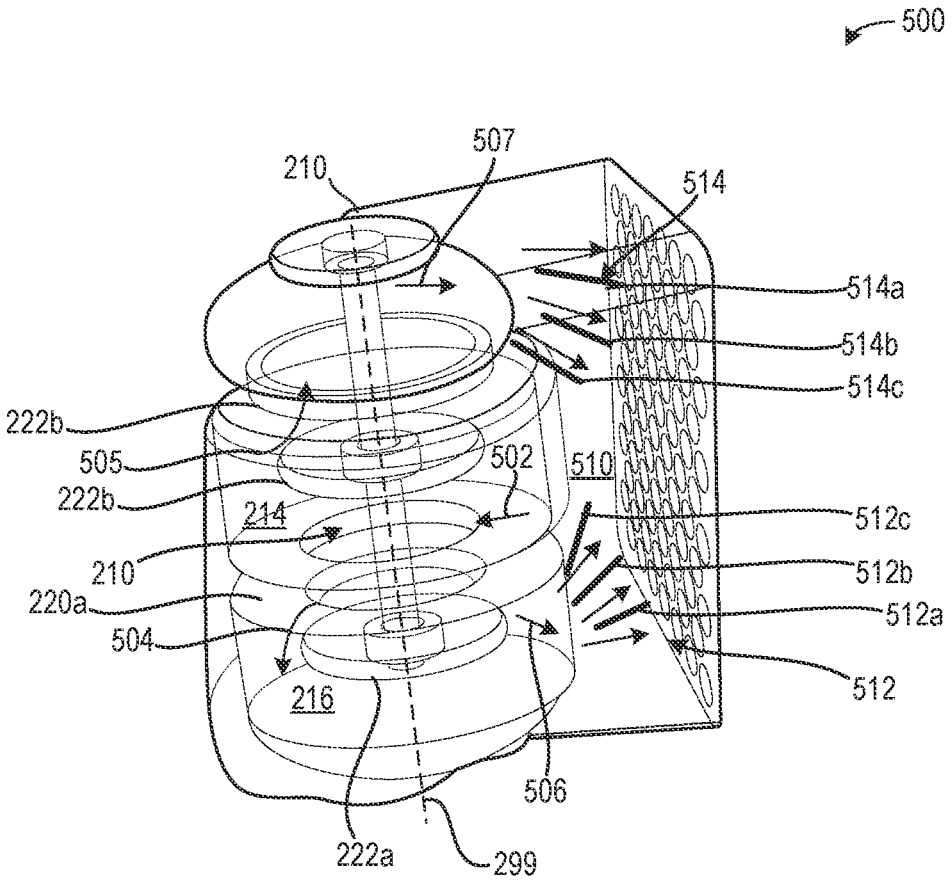
FIG. 5 illustrates an EGR flow distribution through a cooler manifold comprising ribs.

The following description relates to a valve of a cooler. The cooler may include a plurality of tubes through which EGR may flow and reduce in temperature. The cooler may receive EGR from an exhaust passage of an engine and flow cooled EGR to an intake system of the engine, as shown in FIG. 1. The valve may be a dual poppet valve arranged between an inlet and the plurality of tubes of the cooler, as revealed in FIG. 2. The dual poppet valve may be actuated via a camshaft, a schematic of which is shown in FIG. 3. The position of the dual poppet valve relative to the plurality of tubes and the inlet of the cooler is shown in FIG. 4. The cooler may include a plurality of ribs configured to guide and distribute EGR flow uniformly to the plurality of tubes of the cooler, as shown in FIG. 5.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation). FIGS. 2-5 are shown approximately to scale.

Turning now to the figures, FIG. 1 depicts an example of a cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 via a transmission 54, as further described below. Further, a starter motor (not shown) may be coupled to crankshaft 140 via a flywheel to enable a starting operation of engine 10.

Cylinder 14 may be cooled by a cooling sleeve 118 that circumferentially surrounds cylinder 14 and flows a coolant there through. The cooling sleeve 118 may be included in a coolant system that circulates coolant through various components of the engine 10 to provide cooling and heat exchange and may regulate engine temperature and utilization of waste heat. A temperature sensor 116 may be coupled to the cooling sleeve 118 or a cylinder head. A temperature of coolant exiting the engine cylinders may be estimated based on input from the temperature sensor 116. An engine coolant loop may include an engine cooling loop and a cabin heating loop. In some examples, a heater core isolation valve (HCIV) may be positioned to seal the cabin heating loop from the engine cooling loop during some conditions.

In some examples, vehicle 5 may be a hybrid vehicle, such as a plug-in hybrid electric vehicle (PHEV) or a full hybrid electric vehicle (FHEV), with multiple sources of torque available to one or more vehicle wheels 55. In other examples, vehicle 5 is a conventional vehicle with only an engine or an electric vehicle with only an electric machine (s). In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners, including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator 46.

Alternator 46 may be configured to charge system battery 58 using engine torque via crankshaft 140 during engine running. In addition, alternator 46 may power one or more electrical systems of the engine, such as one or more auxiliary systems including a heating, ventilation, and air conditioning (HVAC) system, vehicle lights, an on-board entertainment system, and other auxiliary systems based on their corresponding electrical demands. In one example, a current drawn on the alternator may continually vary based on each of an operator cabin cooling demand, a battery charging requirement, other auxiliary vehicle system demands, and motor torque. A voltage regulator may be coupled to alternator 46 in order to regulate the power output of the alternator based upon system usage requirements, including auxiliary system demands.

Cylinder 14 of engine 10 can receive intake air via a series of intake passages 142 and 144 and an intake manifold 146. Intake manifold 146 can communicate with other cylinders of engine 10 in addition to cylinder 14. One or more of the intake passages may include one or more boosting devices, such as a turbocharger or a supercharger. For example, FIG. 1 shows engine 10 configured with a turbocharger, including a compressor 174 arranged between intake passages 142 and 144 and an exhaust turbine 176 arranged along an exhaust passage 135. Compressor 174 may be at least partially powered by exhaust turbine 176 via a shaft 180 when the boosting device is configured as a turbocharger. However, in other examples, such as when engine 10 is provided with a supercharger, compressor 174 may be powered by mechanical input from a motor or the engine and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

An exhaust system 145 is coupled to cylinder 14 via a poppet valve 156. The exhaust system includes an exhaust manifold 148, an emission control device 178, and exhaust tail pipe 179. Exhaust manifold 148 can receive exhaust gases from other cylinders of engine 10 in addition to cylinder 14. An exhaust gas sensor 126 is shown coupled to exhaust manifold 148 upstream of an emission control device 178. Exhaust gas sensor 126 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO, a HEGO (heated EGO), a NOx, a HC, or a CO sensor, for example. In the example of FIG. 1, exhaust gas sensor 126 is a UEGO. Emission control device 178 may be a three-way catalyst, a NOx trap, various other emission control devices, or combinations thereof.

Engine 10 may further include one or more exhaust gas recirculation (EGR) passages for recirculating a portion of exhaust gas from the engine exhaust to the engine intake. As such, by recirculating some exhaust gas, an engine dilution may be affected which may enhance engine performance by reducing engine knock, peak cylinder combustion temperatures and pressures, throttling losses, and NO emissions. In the depicted embodiment, exhaust gas may be recirculated from exhaust manifold 148 to intake passage 144 via EGR passage 141. The amount of EGR provided to intake passage 144 may be varied by controller 12 via EGR valve 143. In other examples, engine 10 may be configured to also provide low pressure EGR (not shown in FIG. 1) being provided via an LP-EGR passage coupled between the engine intake upstream of the turbocharger compressor 174 and the engine exhaust downstream of the turbine 176.

Furthermore, when the engine 10 is operating and generating exhaust gas, heat from the EGR gases may be extracted through an EGR cooler 149, arranged in the EGR passage 141 in a path of gas flow. The EGR cooler 149 may be a heat exchanger, utilizing cooling by air-to-liquid heat exchange, as an example. Coolant may flow through the EGR cooler 149, absorbing heat from the hot gases and flowing to a heater core where the heat is extracted from the coolant via liquid-to-air heat exchange and directed to a passenger cabin to heat the cabin. The EGR valve 143 may be positioned proximal to an inlet of the EGR cooler 149, upstream of a plurality of tubes in which the EGR is cooled while passing through the EGR cooler 149. The EGR valve 143 and the EGR cooler 149 are described in greater detail with respect to FIG. 2.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used.

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

Each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, spark may be retarded from MBT, such as to expedite catalyst warm-up during engine start or to reduce an occurrence of engine knock.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to a pulse width of a signal FPW received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in an intake passage rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and further configured to inject this fuel mixture directly into cylinder. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to the cooling sleeve 118 or a cylinder head; an ambient temperature (AAT) from a temperature sensor coupled to the vehicle body; an exhaust gas temperature from a temperature sensor 158 coupled to exhaust passage 135; a profile ignition pickup signal (PIP) from a Hall effect sensor 120 (or other type) coupled to crankshaft 140; throttle position (TP) from a throttle position sensor; signal UEGO from exhaust gas sensor 126, which may be used by controller 12 to determine the AFR of the exhaust gas; and an absolute manifold pressure signal (MAP) from a MAP sensor 124. An engine speed signal, RPM, may be generated by controller 12 from signal PIP.

The manifold pressure signal MAP from MAP sensor 124 may be used to provide an indication of vacuum or pressure in the intake manifold. Controller 12 may infer an engine temperature based on the engine coolant temperature and infer a temperature of emission control device 178 based on the signal received from temperature sensor 158.

Controller 12 receives signals from the various sensors of FIG. 1 and employs the various actuators of FIG. 1 to adjust engine operation based on the received signals and instructions stored on a memory of the controller. For example, the controller may obtain the ECT from the temperature sensor 116 and adjust a flow of coolant circulating through the cooling sleeve 118 based on the ECT. Additionally or alternatively, the controller 12 may signal to various valves and coolant pumps to adjust operation thereof to execute a coolant pump diagnostic.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Figure 2:
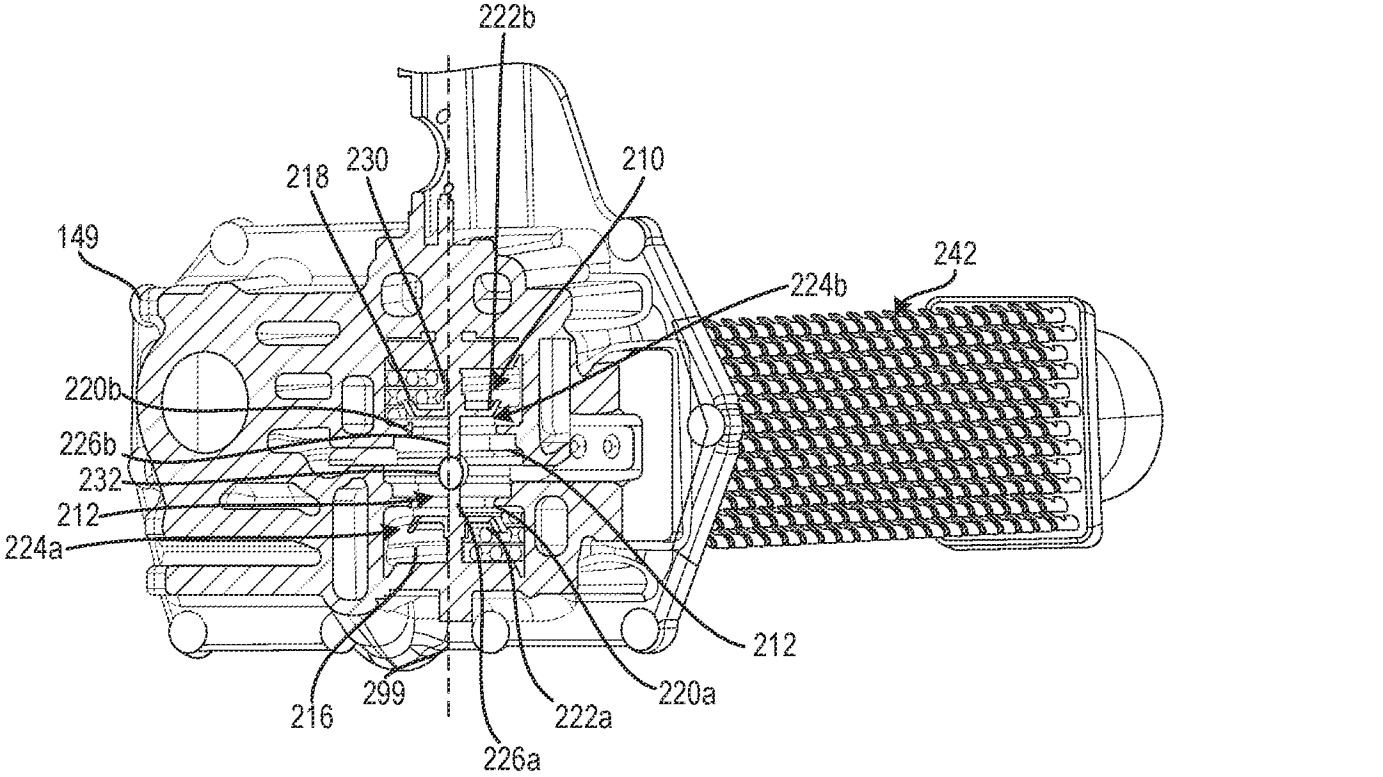
FIG. 2 illustrates an interior of a cooler comprising a dual poppet valve.

Turning now to FIG. 2, it shows an embodiment 200 of the cooler 149. As such, components previously introduced are similarly numbered in this figure and subsequent figures. The cooler 149 may include a dual poppet valve assembly 210. The dual poppet valve assembly 210 may be a non-limiting example of the EGR valve 143 of FIG. 1. The dual poppet valve assembly 210 may include a valve body 212, a primary chamber 214, a first secondary chamber 216 and a second secondary chamber 218. A first valve seat 220*a* may separate the primary chamber 214 and the first secondary chamber 216. A second valve seat 220*b* may separate the primary chamber 214 and the second secondary chamber 218. A first poppet 222*a* may engage with the first valve seat 220*a*, defining a first valve 224*a* of the dual poppet valve assembly 210. A second poppet 222*b* may engage with the second valve seat 220*b*, defining a second valve 224*b* of the dual poppet valve assembly 210.

In some examples, the first poppet 222*a* and the second poppet 222*b* may be identical in shape and size. As such, the amount of EGR flowing passed the first poppet 222*a* and the second poppet 222*b* may be equal. In some embodiments, the first poppet 222*a* and the second poppet 222*b* may be shaped differently, thereby allowing different amount of EGR to flow thereby.

The first valve seat 220*a* and the second valve seat 220*b* may face in opposite directions such that both the first valve 224*a* and the second valve 224*b* open into the primary chamber 214. The first poppet 222*a* may be coupled to a first shaft 226*a* and the second poppet 222*b* may be coupled to a second shaft 226*b*. The first shaft 226*a* and the second shaft 226*b* may be aligned with one another along an axis 299.

The cooler 149 may include a plurality of tubes 242 fluidly coupled to an outlet chamber (e.g., outlet chamber 510 of FIG. 5). The plurality of tubes 242 may receive EGR, wherein coolant and/or air may flow around and between the plurality of tubes 242 to cool EGR flowing therethrough. Each of the plurality of tubes 242 may be fluidly sealed from one another from the outlet chamber to a remainder of the EGR passage.

A camshaft 230 may comprise a cam 232 arranged between the first shaft 226*a* and the second shaft 226*b*. The camshaft 230 may be configured to actuate (e.g., rotate) the cam 232, which may adjust a position of the first shaft 226*a* and the second shaft 226*b*, thereby adjusting a spacing between the first poppet 222*a* and the first valve seat 220*a* and the second poppet 222*b* and the second valve seat 220*b*. In one example, the camshaft 230 may be oriented normal to the first shaft 226*a* and the second shaft 226*b*. Additionally or alternatively, the camshaft 230 may extend through an interior of the first shaft 226*a* and the second shaft 226*b* such that the camshaft 230 and the first shaft 226*a* or the second shaft 226*b* are concentric about the axis 299. Thus, the first shaft 226*a* and the second shaft 226*b* may be hollow and the camshaft 230 may extend therethrough, in one example.

Actuation of the camshaft 230, via a motor or other actuator, may adjust a position of the cam 232. As illustrated in FIG. 3, the cam 232 may include a symmetric shape having a first lobe 312 and a second lobe 314. A first flat section 316 and a second flat section 318 may separate the first lobe 312 and the second lobe 314. The position of the first valve 224*a* and the second valve 224*b* may be adjusted based on a position of the cam 232. In one example, the first poppet 222*a* and the second poppet 222*b* may travel in identical direction parallel to the axis 299. Additionally or alternatively, the first poppet 222*a* and the second poppet 222*b* may travel in opposite directions parallel to the axis 299.

In the position shown in FIG. 3, the cam 232 is rotated such that its longitudinal axis 392 is normal to the axis 299 and its lateral axis 394 is parallel to the axis 299. As such, the first flat section 316 contacts the first shaft 226*a* and the second flat section 318 contacts the second shaft 226*b*. The first poppet 222*a* may be pressed against the first valve seat 220*a* and the second poppet 222*b* may be pressed against the second valve seat 220*b*. Gases in the primary chamber 214 may not flow to either the first secondary chamber 216 or the second secondary chamber 218. In this way, the dual poppet valve assembly 210 is in a fully closed position in the example of FIG. 3.

In the position shown in FIG. 2, the dual poppet valve assembly 210 is in a fully open position. The cam 232 is rotated such that the longitudinal axis 392 is parallel to the axis 299 and the lateral axis 394 is normal to the axis 299. The first lobe 312 is in contact with the first shaft 226*a* and the second lobe 314 is in contact with the second shaft 226*b*. The lobes may press the respective shafts along the axis 299 such that the first poppet 222*a* and the second poppet 222*b* are moved away from the first valve seat 220*a* and the second valve seat 220*b*. Gases entering the primary chamber 214 may flow to both the first secondary chamber 216 and the second secondary chamber 218. An example of EGR flow through the open dual poppet valve assembly 210 and into the plurality of tubes of the EGR cooler is shown in FIG. 5.

In some examples, additionally or alternatively, partially open positions may be generated via actuating the camshaft 230 such that the longitudinal axis 392 and the lateral axis 394 are misaligned with the axis 299 of the dual poppet valve assembly. For example, the dual poppet valve assembly may be in a more open position in response to the lateral axis 394 being more misaligned with the axis 299 relative to the longitudinal axis 392. A magnitude of misalignment may be measured based on an angle between the axes, wherein the magnitude increases as the angle increases.

The camshaft 230 may be configured to open and close the poppets symmetrically such that a position of the first poppet and the second poppet are identical. In some embodiments, additionally or alternatively, the camshaft 230 may be configured to adjust the position of the first poppet and the second poppet differently. For example, the first poppet may be opened or closed prior to the second poppet. In one example, the camshaft 230 may include a first cam engaged with the first shaft and the second cam engaged with the second shaft.

Turning now to FIG. 4, it shows an embodiment 400 illustrating a position of the dual poppet valve assembly 210 relative to an inlet 402 of the cooler 149 and a plate 410. The inlet 402 is oriented to flow EGR into the primary chamber 214 in a first direction normal to the axis 299. The plate 410, which includes a plurality of openings 412, may be configured to flow EGR into the plurality of tubes 242 in a second direction normal to the axis 299 and the first direction.

As illustrated, the axis 299 of the dual poppet valve assembly 210 is misaligned with a central axis 499 of the plate 410. This may result in the dual poppet valve assembly 210 being positioned more upstream to the inlet 402 relative to the central axis 499. By biasing the dual poppet valve assembly 210 toward the inlet 402, opposed to aligning the axis 299 with the central axis 499, EGR flow distribution may be enhanced.

Turning now to FIG. 5, it shows an embodiment 500 illustrating EGR flow through the dual poppet valve assembly 210 and the cooler 149. Arrow 502 illustrates EGR entering the primary chamber 214. Arrow 504 illustrates EGR flowing from the primary chamber 214 to the first secondary chamber 216 via an opening generated between the first poppet 222*a* and the first valve seat 220*a*. Arrow 505 illustrates EGR flowing form the primary chamber 214 to the second secondary chamber 218 via an opening generated between the second poppet 222*b* and the second valve seat 220*b*. Arrow 506 illustrates EGR flowing from the first secondary chamber 216 to an outlet chamber 510 of the cooler 149. Arrow 507 illustrates EGR flowing from the second secondary chamber 218 to the outlet chamber 510.

A first plurality of ribs 512 may distribute EGR corresponding to arrow 506 into different portions of the outlet chamber 510 to enhance distribution of the EGR to the plurality of tubes 242. A second plurality of ribs 514 may distribute EGR corresponding to arrow 507 into different portion of the outlet chamber 510 to enhance distribution of the EGR to the plurality of tubes 242.

The ribs 512 may include a plurality of ribs, including a first rib 512*a*, a second rib 512*b*, and a third rib 512*c*, angled differently to one another. For example, the first rib 512*a* may be less angled than the second rib 512*b*, the second rib 512*b* less angled than the third rib 512*c*, wherein the angle of each rib is measured relative to an axis normal to the axis 299.

The ribs 514 may include a plurality of ribs, including a fourth rib 514*a*, a fifth rib 514*b*, and a sixth rib 514*c*, angled differently to one another. For example, the fourth rib 514*a* may be less angled than the fifth rib 514*b*, the fifth rib 514*b* less angled than the sixth rib 514*c*, wherein the angle of each rib is measured relative to an axis normal to the axis 299. In one example, the ribs 514 may be oriented as a mirror opposite of the ribs 512.

EGR in the outlet chamber 510 may flow to the plurality of tubes. The effect of the ribs 512 and 514, along with the biased positioning of the dual poppet valve, may improve distribution of the EGR into the plurality of tubes. By doing this, EGR cooling may be increased, which may further reduce engine temperatures, and therefore NO generation. Additionally, a longevity of the cooler may be improve via more even EGR distribution.

The disclosure provides support for an exhaust gas recirculation (EGR) system including a dual poppet valve arranged upstream of a cooler relative to a direction of EGR flow, and ribs arranged between the dual poppet valve and a plurality of tubes of the cooler. A first example of the EGR system further includes where the ribs are arranged in an outlet chamber upstream of the plurality of tubes. A second example of the EGR system, optionally including the first example, further includes where the dual poppet valve comprises a first poppet configured to control EGR flow from a primary chamber to a first secondary chamber, the dual poppet valve further comprising a second poppet configured to control EGR flow from the primary chamber to a second secondary chamber. A third example of the EGR system, optionally including one or more of the previous examples, further includes where the ribs are arranged at an interface between the first secondary chamber and an outlet chamber upstream of the plurality of tubes. A fourth example of the EGR system, optionally including one or more of the previous examples, further includes where the ribs are arranged at an interface between the second secondary chamber and an outlet chamber upstream of the plurality of tubes. A fifth example of the EGR system, optionally including one or more of the previous examples, further includes where a camshaft comprising a cam, the cam configured to actuate a first stem coupled to a first poppet and a second stem coupled to a second poppet to adjust a position of the dual poppet valve. A sixth example of the EGR system, optionally including one or more of the previous examples, further includes where the cam is symmetric and comprises two lobes.

The disclosure further provides support for a system including an exhaust gas recirculation (EGR) cooler comprising a plurality of tubes and a dual poppet valve assembly arranged therein and ribs arranged in an outlet chamber between the dual poppet valve assembly and the plurality of tubes, wherein the dual poppet valve assembly comprises a first poppet and a second poppet actuated via a cam of a camshaft, the first poppet configured to control EGR flow from a primary chamber to a first secondary chamber and the second poppet configured to control EGR flow from the primary chamber to a second secondary chamber, each of the first secondary chamber and the second secondary chamber are fluidly coupled to the outlet chamber. A first example of the system further includes where the EGR cooler further comprises an inlet and a plate, wherein the inlet flows EGR in a first direction normal to a central axis of the dual poppet valve assembly and the plate flows EGR in a second direction normal to the central axis and the first direction. A second example of the system, optionally including the first example, further includes where the plate comprises a plurality of openings, each opening of the plurality of openings is coupled to a tube of the plurality of tubes. A third example of the system, optionally including one or more of the previous examples, further includes where the central axis of the dual poppet valve assembly is misaligned with a central axis of the plate. A fourth example of the system, optionally including one or more of the previous examples, further includes where the dual poppet valve assembly is biased toward the inlet relative to a position where the central axis of the dual poppet valve assembly is aligned with the central axis of the plate. A fifth example of the system, optionally including one or more of the previous examples, further includes where the cam is symmetric. A sixth example of the system, optionally including one or more of the previous examples, further includes where the cam comprises a first lobe and a second lobe configured to actuate the first poppet and the second poppet. A seventh example of the system, optionally including one or more of the previous examples, further includes where the ribs are angled relative to a direction of EGR flow and arranged between the outlet chamber, the first secondary chamber, and the second secondary chamber.

The disclosure additionally provides support for an exhaust gas recirculation (EGR) system including a dual poppet valve assembly arranged upstream of a cooler relative to a direction of EGR flow, the dual poppet valve assembly comprising a first poppet coupled to a first shaft and a second poppet coupled to a second shaft, a camshaft comprising a cam arranged between the first shaft and the second shaft, and ribs arranged between a plurality of tubes of the cooler and the first poppet and the second poppet, wherein the ribs are angled relative to a direction of EGR flow into the plurality of tubes. A first example of the EGR system further includes where the cam is symmetric and comprises a first lobe and a second lobe, and wherein a first flat section and a second flat section of the cam separate the first lobe and the second lobe. A second example of the EGR system, optionally including the first example, further includes where a central axis of the dual poppet valve assembly is misaligned with a central axis of a plate coupled to the plurality of tubes. A third example of the EGR system, optionally including one or more of the previous examples, further includes where the ribs include an outer rib, a middle rib, and an inner rib, wherein the outer rib is less angled than the middle rib, and the middle rib is less angled than the inner rib. A fourth example of the EGR system, optionally including one or more of the previous examples, further includes where the ribs are coupled to an interface between an outlet chamber upstream of the plurality of tubes, a first secondary chamber between a valve seat of the first poppet and the outlet chamber, and a second secondary chamber between a valve seat of the second poppet and the outlet chamber, and wherein EGR flow from a primary chamber to the first secondary chamber and the second secondary chamber is controlled via the first poppet and the second poppet.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust gas recirculation (EGR) system, comprising:

a dual poppet valve arranged upstream of a cooler relative to a direction of EGR flow, and ribs arranged between the dual poppet valve and a plurality of tubes of the cooler.

2. The EGR system of claim 1, wherein the ribs are arranged in an outlet chamber upstream of the plurality of tubes.

3. The EGR system of claim 1, wherein the dual poppet valve comprises a first poppet configured to control EGR flow from a primary chamber to a first secondary chamber, the dual poppet valve further comprising a second poppet configured to control EGR flow from the primary chamber to a second secondary chamber.

4. The EGR system of claim 3, wherein the ribs are arranged at an interface between the first secondary chamber and an outlet chamber upstream of the plurality of tubes.

5. The EGR system of claim 3, wherein the ribs are arranged at an interface between the second secondary chamber and an outlet chamber upstream of the plurality of tubes.

6. The EGR system of claim 1, further comprising a camshaft comprising a cam, the cam configured to actuate a first stem coupled to a first poppet and a second stem coupled to a second poppet to adjust a position of the dual poppet valve.

7. The EGR system of claim 6, wherein the cam is symmetric and comprises two lobes.

8. A system, comprising:

an exhaust gas recirculation (EGR) cooler comprising a plurality of tubes and a dual poppet valve assembly arranged therein and ribs arranged in an outlet chamber between the dual poppet valve assembly and the plurality of tubes; wherein the dual poppet valve assembly comprises a first poppet and a second poppet actuated via a cam of a camshaft, the first poppet configured to control EGR flow from a primary chamber to a first secondary chamber and the second poppet configured to control EGR flow from the primary chamber to a second secondary chamber, each of the first secondary chamber and the second secondary chamber are fluidly coupled to the outlet chamber.

9. The system of claim 8, wherein the EGR cooler further comprises an inlet and a plate, wherein the inlet flows EGR in a first direction normal to a central axis of the dual poppet valve assembly and the plate flows EGR in a second direction normal to the central axis and the first direction.

10. The system of claim 9, wherein the plate comprises a plurality of openings, each opening of the plurality of openings is coupled to a tube of the plurality of tubes.

11. The system of claim 9, wherein the central axis of the dual poppet valve assembly is misaligned with a central axis of the plate.

12. The system of claim 11, wherein the dual poppet valve assembly is biased toward the inlet relative to a position where the central axis of the dual poppet valve assembly is aligned with the central axis of the plate.

13. The system of claim 8, wherein the cam is symmetric.

14. The system of claim 8, wherein the cam comprises a first lobe and a second lobe configured to actuate the first poppet and the second poppet.

15. The system of claim 8, wherein the ribs are angled relative to a direction of EGR flow and arranged between the outlet chamber, the first secondary chamber, and the second secondary chamber.

16. An exhaust gas recirculation (EGR) system, comprising:

a dual poppet valve assembly arranged upstream of a cooler relative to a direction of EGR flow, the dual poppet valve assembly comprising a first poppet coupled to a first shaft and a second poppet coupled to a second shaft;

a camshaft comprising a cam arranged between the first shaft and the second shaft; and ribs arranged between a plurality of tubes of the cooler and the first poppet and the second poppet, wherein the ribs are angled relative to a direction of EGR flow into the plurality of tubes.

17. The EGR system of claim 16, wherein the cam is symmetric and comprises a first lobe and a second lobe, and wherein a first flat section and a second flat section of the cam separate the first lobe and the second lobe.

18. The EGR system of claim 16, wherein a central axis of the dual poppet valve assembly is misaligned with a central axis of a plate coupled to the plurality of tubes.

19. The EGR system of claim 16, wherein the ribs include an outer rib, a middle rib, and an inner rib, wherein the outer rib is less angled than the middle rib, and the middle rib is less angled than the inner rib.

20. The EGR system of claim 16, wherein the ribs are coupled to an interface between an outlet chamber upstream of the plurality of tubes, a first secondary chamber between a valve seat of the first poppet and the outlet chamber, and a second secondary chamber between a valve seat of the second poppet and the outlet chamber, and wherein EGR flow from a primary chamber to the first secondary chamber and the second secondary chamber is controlled via the first poppet and the second poppet.

* * * * *